US005170509A

United States Patent [19]

Leopold

[11] Patent Number: 5,170,509

[45] Date of Patent: Dec. 15, 1992

[54] CAP WITH DECORATIVE HAIR ATTACHMENT

[76] Inventor: Lynnabeth Leopold, 7040 Avenida Encinas #104, Carlsbad, Calif. 92009

[21] Appl. No.: 817,344

[22] Filed: Jan. 6, 1992

[51] Int. Cl.[5] ..... A42B 1/00

[52] U.S. Cl. ..... 2/199; 2/196; 2/209.1; 2/DIG. 6; 132/273

[58] Field of Search ..... 2/171, 195, 196, 198, 2/199, 209.1, 209.3, DIG. 6; 132/212, 273

[56] References Cited

U.S. PATENT DOCUMENTS 4,998,544 3/1991 Obergfell ..... 2/209.3
5,003,640 4/1991 Pizzacar ..... 2/DIG. 6
5,044,385 9/1991 Rhodes ..... 132/273

FOREIGN PATENT DOCUMENTS 785551 8/1935 France ..... 132/273
2585543 2/1987 France ..... 2/209.1

*Primary Examiner*—Werner H. Schroeder
*Assistant Examiner*—Diana L. Biefeld
*Attorney, Agent, or Firm*—Gregory J. Nelson

[57] ABSTRACT

An accessory item including a cap having a cut-out through which the wearer's hair may rearwardly extend. A decorative hair band is attached to the rear of the cap. In an alternate embodiment, a hair piece is attached to the hair band to simulate a natural braid or ponytail.

9 Claims, 2 Drawing Sheets

CAP WITH DECORATIVE HAIR ATTACHMENT

The present invention relates to an item of apparel and more particularly relates to a cap or protective head covering which has a decorative hair band attachment which may be secured to the wearer's hair.

Caps of various styles and shapes have for some time been worn for protection and as a fashion accessory. Caps are often part of a coordinated outfit worn for some particular athletic activity such as baseball, roller skating, jogging or the like. One problem is that when a wearer actively engages in physical or athletic activities of this type, the cap may become askew or may be entirely dislodged from the user's head.

It may also be desirable for women with short or unkept hair to utilize such fashionable caps incorporating a hair piece affixed to the decorative attachment which would give the appearance of a lengthy ponytail or braid.

Accordingly, it is a principle object of the present invention to provide a fashionable sports cap with a decorative hair band accessory which is attachable about the user's hair.

It is another object of the present invention to provide a cap and an integrally attached decorative, elasticized item which is securable to the user's hair.

It is another object of the present invention to provide a cap and an integrally attached decorative, elasticized accessory which incorporates a hair piece simulating a ponytail or braid.

It is a primary object of the present invention to provide a fashionable apparel item to be worn on the user's head with an attached decorative elastic hair band securable about the user's hair.

Briefly, the present invention includes a cap or head covering of the type having a crown portion which fits about the user's head and which cap may include a forwardly extending visor or bill. The rear of the crown has a cut-out portion and at least a portion of the periphery of the crown at the cut-out includes a band which adjusts the cap to fit various head sizes. A decorative hair band is attached to the rear of the cap which band is an annular fabric member which is elasticized having an aperture through which the wearer's hair may rearwardly extend. The hair band accessory serves to secure the cap in place, adds a fashionable appearance to the cap and also serves to at least partially cover the opening or cut-out at the rear of the cap. In an alternate embodiment, a hair piece is attached to the hair band to simulate a natural braid or ponytail.

The above and other objects and advantages of the present invention will be more fully understood from the following specification, claims and drawings in which:

Figure 1:
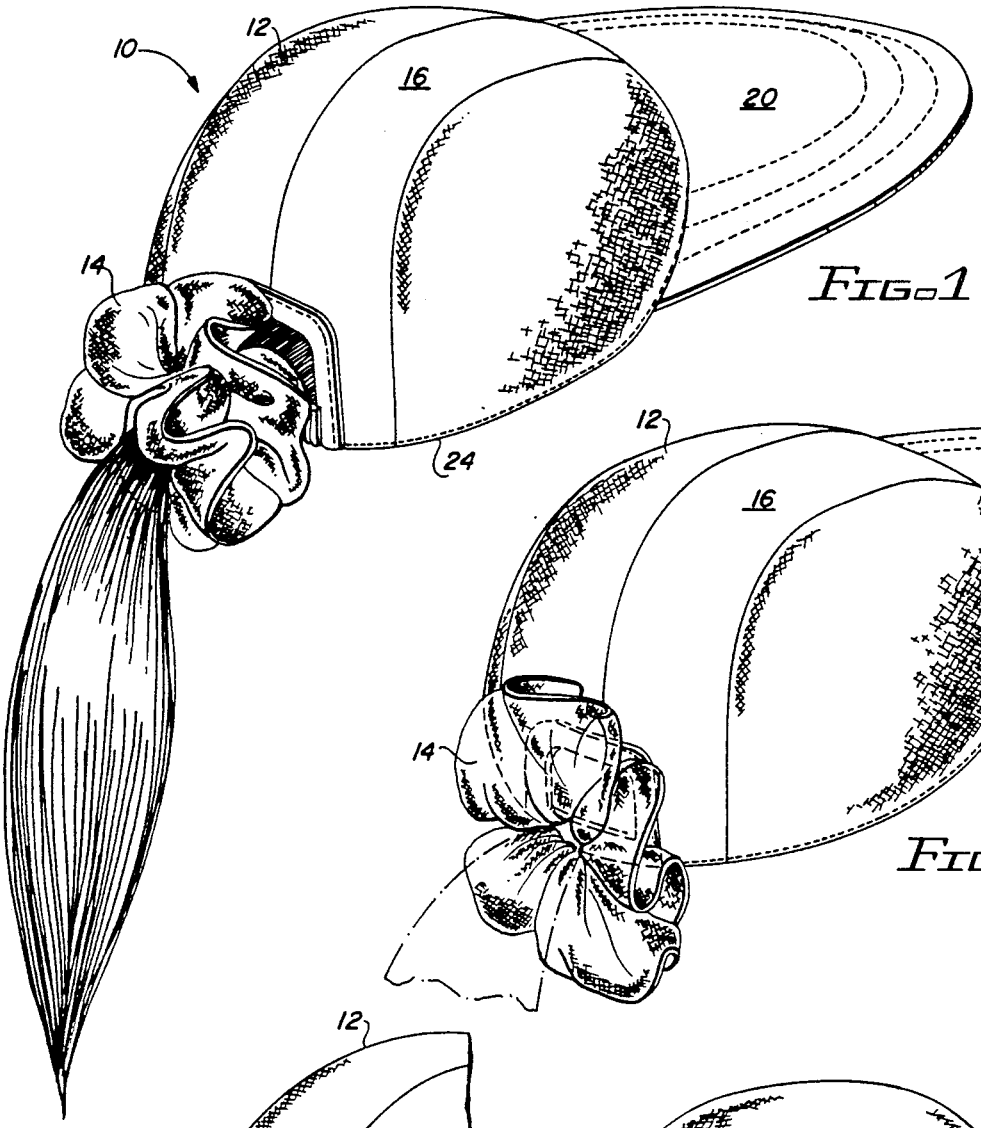
FIG. 1 is a rear perspective view of the cap and hair band showing the hair band doubled around the ponytail of a wearer.

Turning now to the drawings, the cap and hair band apparel item is generally designated by the numeral 10 and includes cap portion 12 and hair band 14. The cap 12 can be of any conventional design and is shown having a crown 16 of fabric which rests on the upper part of the head of the user. The cap may be constructed of any suitable material such as fabric, plastic, leather or a combination of these materials. A bill or visor 20 extends forwardly from the front of the cap and is relatively rigid and when worn generally occupies the position above the eyes of the wearer.

The rear of the cap is provided with a cut-out 22 which extends upwardly from the lower peripheral edge 24 of the cap. The cut-out 22 may be defined by a seam or edge 26. A strap 28 extends across the opening or cut-out generally aligned with the lower peripheral edge 24 of the cap. The strap provides for adjustment so the cap may be worn by individuals having different head sizes. Generally the strap will be elasticized or may be adjustable in length at a buckle or a plurality of apertures in one strap which selectively register with posts in an overlapping strap as is well known. The particular construction to achieve adjustability may vary and for purposes of illustration, an elasticized strap is shown which strap may expand and contract with the particular head size characteristics of the user.

Figure 2:
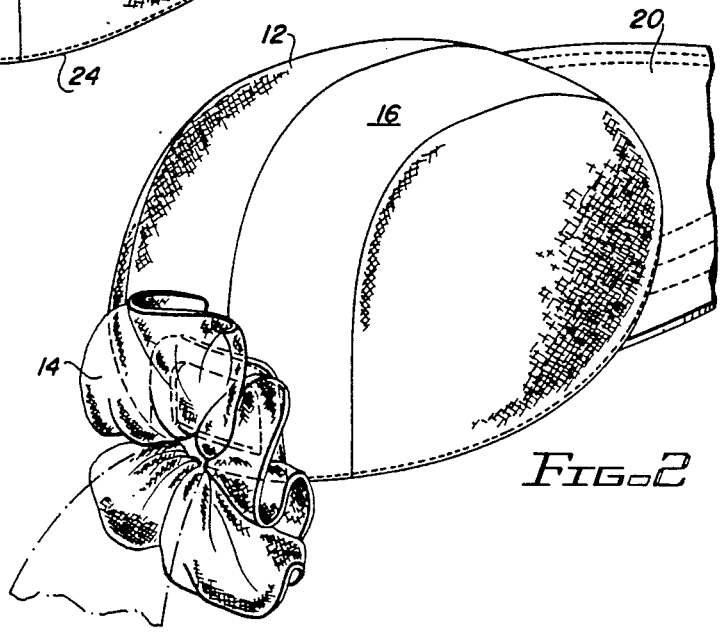
FIG. 2 is a view similar to FIG. 1 with the user's hair shown extending through the hair band and the hair band broken away to illustrate the cut-out in the rear of the cap.
Figure 3:
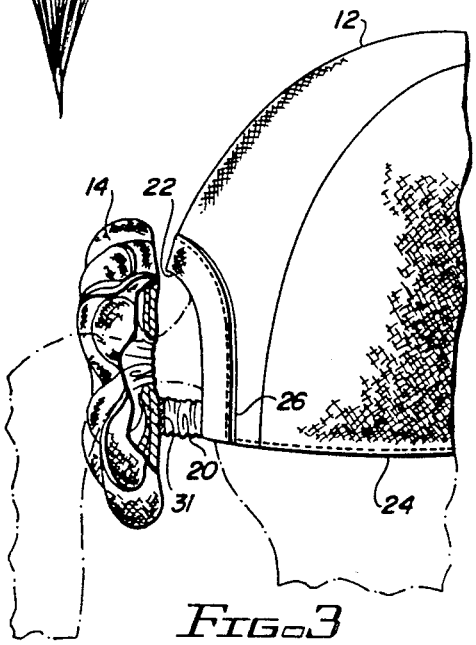
FIG. 3 is a side view showing the rear of the cap, hair band and ponytail.
Figure 4:
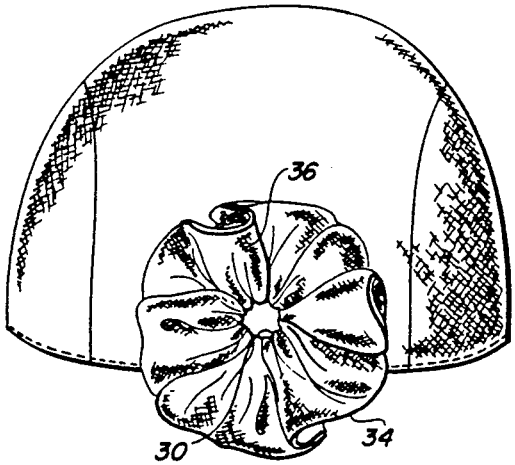
FIG. 4 is a rear view of the cap and hair band.

Hair band 14 is shown attached to the exterior of the rear of the cap in a position generally aligned with the recess 22. The hair band 14 is both a decorative item and a functional fashion accessory. The hair band is preferably fabricated from a suitable fabric material and is annular in configuration having a central aperture 30 about which an elasticized member extends as will be more fully explained hereafter. The hair band has an outer peripheral edge 34 and in its normal position as best shown in FIGS. 2 and 4, is gathered so as to form a plurality of ruffles or pleats 36. The aperture 30 generally aligns with the cut-out 22 at the rear of the cap and the hair band is secured to the cap at a suitable location. Preferably, as shown, the hair band is secured to the cap at a location below aperture 30 by a suitable tack stitch 31. Alternatively, the hair band can be detachably secured to the cap at mating loop and hook members or by suitable snap fastener.

Figure 5:
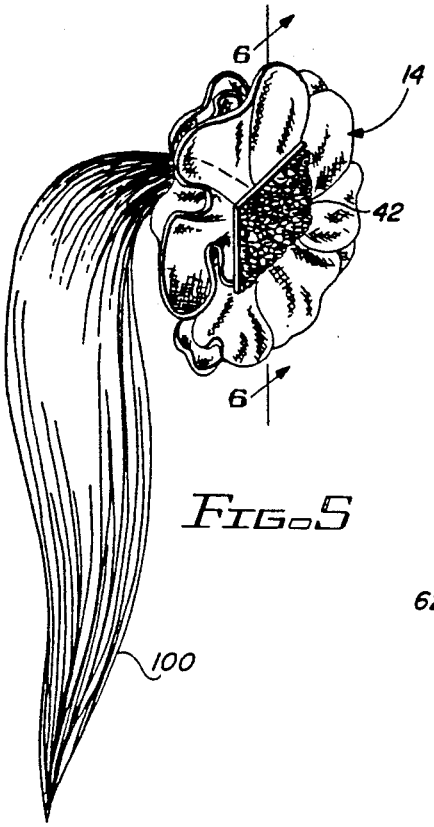
FIGS. 5 and 6 illustrate an alternate construction in which the hair band is detachably secured to the cap.
Figure 6:
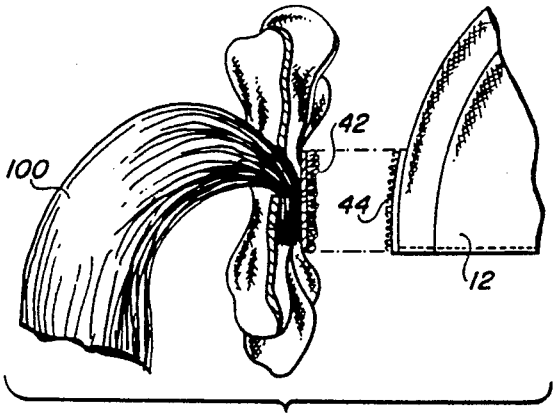
Figure 7:
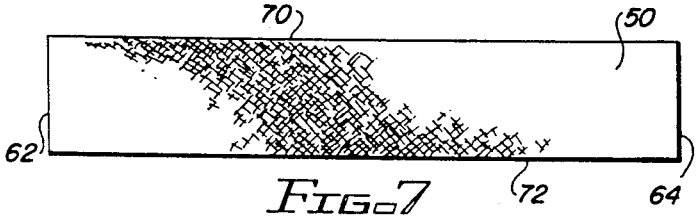
FIGS. 7 to 10 illustrate the steps in the construction of the hair band.

FIGS. 5 and 6 illustrate the detachable securement of the hair band 14 to the rear of the hat 12 by detachable loop and hook fastener members 42 and 44, such as the type sold under the trademark Velcro.

The construction of the hair band is shown in FIGS. 7 to 10. As indicated above, the band may be made from any suitable material such as a fabric of the desired color or pattern. A cotton fabric will work well for this purpose.

Figure 8:
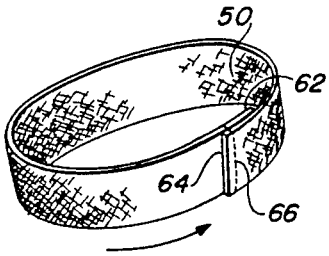
Figure 9:
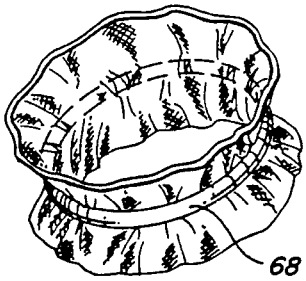
Figure 10:
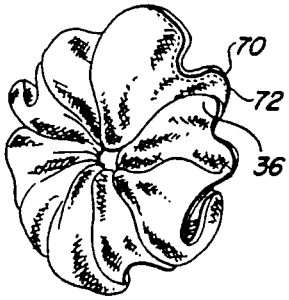

The strip of fabric is selected and cut into a generally elongate, rectangular piece 50 as shown in FIG. 6. The piece 50 is formed into a generally circular construction and ends joined as seen in FIG. 8. The opposite ends 62, 64 of the assembly are then sewn together at 66 so that a continuous circular band is formed. An elastic member 68 is placed about the exterior of the fabric band. The elastic member 68 has a diameter less than the diameter of the fabric band.

The elasticized band 68 is small enough so that it will tend to pull or gather the assembly together forming the pleats or ruffles 36 as has been described. The outer edges 70 and 72 of the band are then joined by a finishing stitch at 80 resulting in the construction shown.

In use, the wearer will place the cap on the wearer's head and a section of the wearer's hair extended through the cut-out 22 and through the aperture 30 in the hair band. The wearer's hair may be in the form of a ponytail, as shown, or a braid or any similar gathered hair style. The hair is extended through the aperture at the rear of the cap and then through the elasticized opening at the center of the hair band. The combination provides the practical advantage of the cap protecting the wearer's head and also shading the wearer's eyes.

The addition of the hair band provides the desirable appearance of a fashion accessory and provides substantial practical advantages. The hair band assists in securing the cap on the head of the user so that it will not shift or fall off. The hair band being decorative and ruffled and of a size larger than the cut-out 22 will also serve to at least partially cover or obscure the opening in the rear of the cap. The band also serves the purpose of securing the user's hair so that a separate band or other hair appliance will not necessarily have to be secured to the user's hair.

In FIG. 1, the cap and hair band are shown and in FIG. 1, the hair band has been twisted in FIG.-8 fashion and doubled over itself and the user's hair extended through the band. The doubled effect gives a fuller more ruffled appearance and may be preferred by some wearer's.

In FIG. 5, the hair band is shown with an artificial ponytail 100 which is secured to the hair band. Thus, if the wearer does not have long hair, the wearer can achieve the appearance of having longer hair.

It will be obvious to those skilled in the art to make various changes, alterations and modifications to the invention described herein. To the extent that these changes, alterations and modifications do not depart from the spirit and scope of the appended claims, they are intended to be encompassed therein.

I claim:

1. A hair apparel item comprising:

(a) a cap having a crown which is to be worn on the wearer's head having a front and rear, said crown defining an opening in the rear of the cap; and (b) a hair band having an aperture therein, said aperture generally being aligned with the opening in the rear of the cap, said hair band being attached to the cap and including elasticized means for engaging at least a portion of the hair of the user whereby the user may extend a portion of the user's hair through said opening and aperture in said band to secure said cap and hair in place.

2. The apparel item of claim 1 wherein said cap has a forwardly extending visor disposed at the front of the cap.

3. The apparel item of claim 1 wherein said cap includes a band extending generally transverse of said opening in said cap, said band including means for adjusting the size of said cap.

4. The apparel item of claim 1 wherein said hair band is generally annular having peripherally extending ruffles.

5. The apparel item of claim 4 wherein said hair band is fabricated from fabric and includes an elastic band peripherally extending about said aperture.

6. The apparel item of claim 4 wherein said hair band includes an attachable hair piece which simulates a ponytail or braid.

7. The apparel item of claim 1 wherein said hair band is detachably secured to said cap.

8. The apparel item of claim 7 wherein said hair band and said cap have cooperating mating loop and hook fabric fastener members.

9. A method of making an apparel item comprising:

(a) fabricating a generally elongate fabric piece having opposite ends and opposite edges;

(b) joining the ends of the fabric piece to form a continuous band;

(c) applying an elastic member about the continuous band to cause the band to form an annular, ruffled member; and (d) securing the opposite edges together;

(e) applying the annular, ruffled member to the rear of a cap.

* * * * *